United States Patent [19]

Horio et al.

[11] Patent Number: 4,629,942

[45] Date of Patent: Dec. 16, 1986

[54] GAS DISCHARGE DISPLAY PANEL HAVING CAPACITIVELY COUPLED, MULTIPLEX WIRING FOR DISPLAY ELECTRODES

[75] Inventors: Kenji Horio, Kobe; Akira Otsuka, Akashi; Tsuyoshi Tanioka, Musashino, all of Japan

[73] Assignee: Fujitsu Limited, Kanagawa, Japan

[21] Appl. No.: 767,874

[22] Filed: Aug. 21, 1985

[30] Foreign Application Priority Data

Aug. 31, 1984 [JP] Japan ..... 59-182078

[51] Int. Cl.[4] ..... H05B 37/00

[52] U.S. Cl. ..... 315/169.4

[58] Field of Search ..... 315/169.4; 340/752, 340/758, 759; 313/582, 584

*Primary Examiner*—Harold Dixon

*Attorney, Agent, or Firm*—Staas & Halsey

[57] ABSTRACT

A multiplex wiring circuit for a gas discharge panel which reduces the number of driver circuits normally used, by a unique capacitive coupling to the display electrodes through a multiplex circuit arranged on the peripheral portions of the display substrates.

15 Claims, 10 Drawing Figures

GAS DISCHARGE DISPLAY PANEL HAVING CAPACITIVELY COUPLED, MULTIPLEX WIRING FOR DISPLAY ELECTRODES

BACKGROUND OF THE INVENTION

1. Field of the Invention

This invention relates to a gas discharge display panel and, more specifically, to an AC-driven, dot-matrix plasma display panel having multiplex wiring for the display electrodes thereof enabling a reduction in the required number of driver circuits, relative to the number of display electrodes, for operating the panel.

2. State of the Prior Art

While various types of flat-panel display devices are known, gas discharge display panels, also known as plasma display panels, have been adopted in a wide number and variety of applications, including use as displays with computer peripheral devices and terminals and with many other types of equipment, such as electronic cash registers, fuel supply indication displays (e.g., dispensed gallons and corresponding purchase cost of fuel) at gasoline stations, time indicators, and the like. Plasma display panels have outstanding features such as high brightness and high contrast ratio as well as long life and suitability for use in relatively large scale displays, contributing to their wide and varied use.

AC-driven plasma display panels are particularly well suited for use in dot-matrix character display devices, in view of the inherent memory function of such panels with respect to data written therein for display. More specifically, in such a panel, each display dot is produced by a gaseous discharge within a discharge cell defined by spatially intersecting electrodes which are covered by corresponding insulating layers and which define therebetween a discharge gas gap. Each discharge, producing a display dot as a result of data written into the display, is effectively memorized in the form of a stored wall charge which is generated by the discharge and established on a corresponding, inner surface of one of the insulating layers of the panel. The wall charge thus produced in a given half-cycle of the applied AC driving voltage is effectively superimposed in additive relationship on the successive half-cycle of the driving voltage applied to that same cell. Thus, if an externally applied voltage of sufficient amplitude is applied to a given gas discharge cell for initiating a discharge, such as a "writing voltage," the gas discharge at that cell thereafter may be sustained by the application of an external voltage of a lower voltage level, since the effective voltage at the cell includes the additive effect of the wall charge potential and the lower amplitude sustaining voltage applied thereto. As a result, a given discharge cell functions in response to the application of a voltage thereto as a bi-state device, taking into account its immediately preceding condition or state. Namely, if a cell is undergoing a discharge (i.e., is "on"), application thereto of a continuous sustaining voltage of lower amplitude than that necessary to initiate the discharge will nevertheless suffice to sustain the discharge in the cell. Conversely, if the cell currently is "off" and thus not sustaining a discharge, application thereto of a sustaining voltage will not produce a discharge; instead, a writing voltage must be applied thereto to initiate a discharge in the cell. This bi-state or bistable characteristic of each cell, as before noted, is a result of the inherent memory function established by the stored wall charge.

The significance of the inherent memory function to the requirements for driving such a panel is that, once data is written into a given discharge cell, there is no need to provide for repetitive or continuous writing of that data into that cell and instead, the memory function will maintain the discharge in the cell, and thus maintain the data. By contrast, in so-called "refresh" mode display panels, data must be continuously written into a cell to maintain same in continuous discharge. Refresh type operation is usually essential to other types of flat-panel display devices, such as DC-driven gas discharge display panels and liquid crystal display panels. Refresh operation introduces other problems in addition to the requirement of continuous addressing of a given cell, including reducing the brightness or contrast ratio which may be achieved by the panel for a given addressing rate, along with decreasing the capacity of the display. By employing the advantages of the inherent memory function, display devices employing AC-driven plasma display panels having large display capacities, such as a 512×512 dot matrix display, have been put into practical use, and efforts to develop a panel having a capacity of 1,024×1,024 dots or greater continues even today.

Closely aligned with the importance of increasing the dislay capacity of such display panels is the problem of reducing the complexity and cost of the driver circuits for the display. For example, in conventional AC-driven dot-matrix plasma display panels, a driver circuit is provided for each of the X- and Y-electrodes. Thus, for a 512×512-dot panel, 1,024 driver circuits are required. As the display capacity of the panel increases, the number of driver circuits concomitantly increases. Thus, reducing the number of driver circuits has become a crucial requirement for achieving cost reduction in dot-matrix display devices, particularly in such devices in which the display panel requires high driving voltages, as typically is true of AC-driven plasma display panels.

Because of the inherent memory capability of AC-driven plasma display panels, as above noted, the individual cells need not be addressed on a continuing basis as in refresh mode operation, but only when data is to be written into a given cell. As a result, the number of driver circuits associated with the X-electrodes, or the number thereof associated with the Y-electrodes—or both—of an AC-driven dot-matrix plasma display panel may be decreased significantly by time-sharing, or multiplexing, the wiring circuits connecting the driver circuits to the electrodes, so long as the electrodes associated with a given discharge cell may be supplied individually with the necessary voltage for writing data into the cell during a writing cycle, following which a sustaining voltage commonly applied to all cells of the panel will sustain, or maintain, discharges in those addressed cells already in discharge (i.e., the "on" cells) while not producing discharges in cells not previously addressed by a writing voltage (i.e., the "off" cells).

A gas discharge panel having capacitively coupled multiplex wiring for the display electrodes is disclosed in the Japanese published patent application Tokukaisho 58-46388, published Mar. 17, 1983. Thus, while the concept of multiplexing the display electrodes of a plasma display panel has been recognized and steps taken to achieve practical implementations of same, there nevertheless has remained a need for improving the configuration of such circuits to achieve improved yields in the fabrication of such circuits and improved reliability and stability in the operation thereof. This need is all the greater, as efforts are made to achieve AC-driven, dot-matrix type plasma display panels of ever greater display capacity.

SUMMARY OF THE INVENTION

Accordingly, it is an object of the present invention to provide a gas discharge display panel having an improved, multiplex wiring pattern for the display electrodes.

Yet another object of the present invention is to provide a gas discharge display panel having multiplex wiring for the display electrodes wherein the panel is easy to fabricate, affording high yields of the fabricated devices.

Yet another object of the present invention is to provide large coupling capacitances in the implementation of a multiplex wiring circuit for the display electrodes of a gas discharge display panel.

The foregoing and other objects and advantages of the invention are achieved in accordance with the multiplex wiring circuits for the display electrodes of a plasma display panel, as herein set forth. Particularly, the display panel comprises first and second substrates having respective first and second pluralities of generally parallel display electrodes arranged thereon, respectively coated with first and second insulating layers, and spaced apart so as to define a gap therebetween which is filled with a discharge gas. Preferably, first and second protection layers (see, e.g., U.S. Pat. No. 3,714,762—Nakayama et al.) are formed on the respective first and second insulating layers.

The substrates are oriented such that the respective first and second pluralities of display electrodes extend in transverse relationship and thus spatially intersect each other across the discharge gas and define thereby a matrix of plural discharge cells corresponding to the intersections. Each discharge cell is capable of being selectively fired by the application of appropriate voltages to its associated X- and Y-display electrodes and to develop a wall charge for maintaining the discharge by a lower level sustaining voltage continuously applied thereto, as hereinbefore described. The matrix of intersections, or discharge cells, thus defines a corresponding matrix of display dots comprising the display area of the panel.

The multiplex wiring circuit in accordance with the invention may be incorporated on either or both of the substrates. With reference to a first such substrate, the substrate is extended in the direction of the first plurality of display electrodes formed thereon, so as to include first and second peripheral portions extending beyond the display array portion thereof to provide structural support for the multiplex wiring circuit. Particularly, a first plurality of parallel-related driving electrodes is formed on the first substrate peripheral portion, extending transversely of the direction of the display electrodes and of sufficient length to traverse all of the first plurality of display electrodes. A second plurality of driving electrodes is formed in aligned relationship on the second substrate peripheral portion, extending transversely of the direction of the display electrodes. The driving electrodes of the second plurality are of the same length, successive ones thereof traversing respectively associated, successive groups of the display electrodes, each group encompassing the same number of display electrodes. The number of display electrodes in each group, moreover, corresponds to the number of driving electrodes of the first plurality. The first and second driving electrodes are covered by an insulating layer comprising a dielectric. First and second pluralities of coupling electrodes are formed on the surface of the dielectric layer so as to be capacitively coupled to the respectively corresponding ones of the underlying, first and second driving electrodes. A first plurality of display electrode extensions extend from a first edge of the display area to connect the display electrodes to respectively corresponding ones of said first plurality of coupling capacitors, and a second plurality of display electrode extensions extend from the opposite, second edge of the display area to connect the display electrodes to respectively corresponding ones of the second plurality of coupling capacitors. Thus, each display electrode is connected through its first extension to its corresponding first coupling electrode and thereby is capacitively coupled to a corresponding one of the first plurality of driving electrodes and is connected through its second extension to its corresponding second coupling electrode and thereby is capacitively coupled to its respectively corresponding second driving electrode. Thus, the display electrodes are organized in a plurality of successive groups, each group comprising the same number of successive electrodes; moreover, the corresponding electrodes of each of the successive groups are connected through their respective first extensions and first coupling electrodes for capacitive coupling to a respective common one of the first plurality of driving electrodes, and all of the electrodes of a given group are connected through their respective second extensions and corresponding second coupling electrodes for capactive coupling to a common, corresponding one of said second plurality of driving electrodes.

An individual one of the first plurality of display electrodes then is selected, or addressed, by simultaneously applying first and second driving voltages of appropriate levels to the pair of driving electrodes of the first and second pluralities thereof which is associated with the selected display electrode.

The multiplex wiring circuit of the invention, since provided on the peripheral portions of the substrate, may incorporate coupling and driving electrodes of sufficient size to achieve required electrical characteristics in the driving of the display electrodes, and may be configured and oriented thereon in such ways as to reduce electrical crosstalk and other undesired characteristics which are introduced by prior multiplex wiring circuits. Significantly, the display electrodes within the display area of the substrate may be of conventional configurations, dimensions and pitch or otherwise selected as desired, since the multiplex wiring circuit therefor is external of the display area and specifically is provided on the peripheral portions of the associated substrate. The simplified structure thus afforded reduces fabrication complexities and contributes to improved yields as well as improved operating characteristics.

BRIEF DESCRIPTION OF THE DRAWINGS

The foregoing and other objects and advantages of the present invention will become more apparent from the following detailed description taken with reference to the accompanying drawings, in which.

DETAILED DESCRIPTION OF THE PREFERRED EMBODIMENTS

Figure 1:
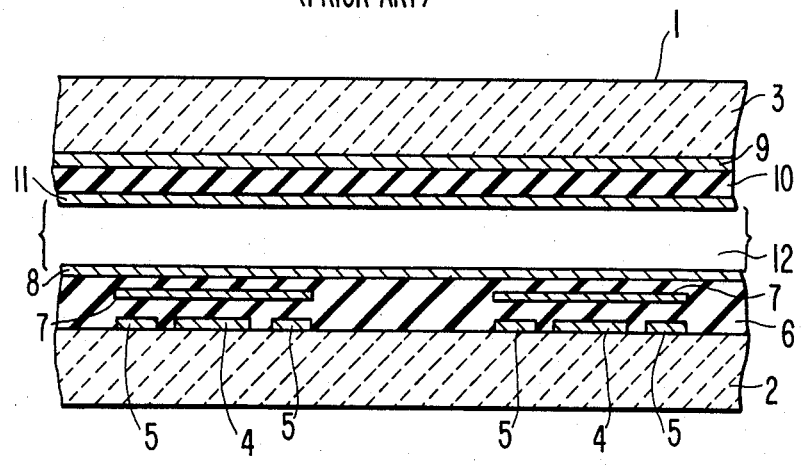
FIG. 1. (PRIOR ART)
FIG. 1 is a cross-sectional, elevational view of a portion of the structure of a plasma display panel.
Figure 2:
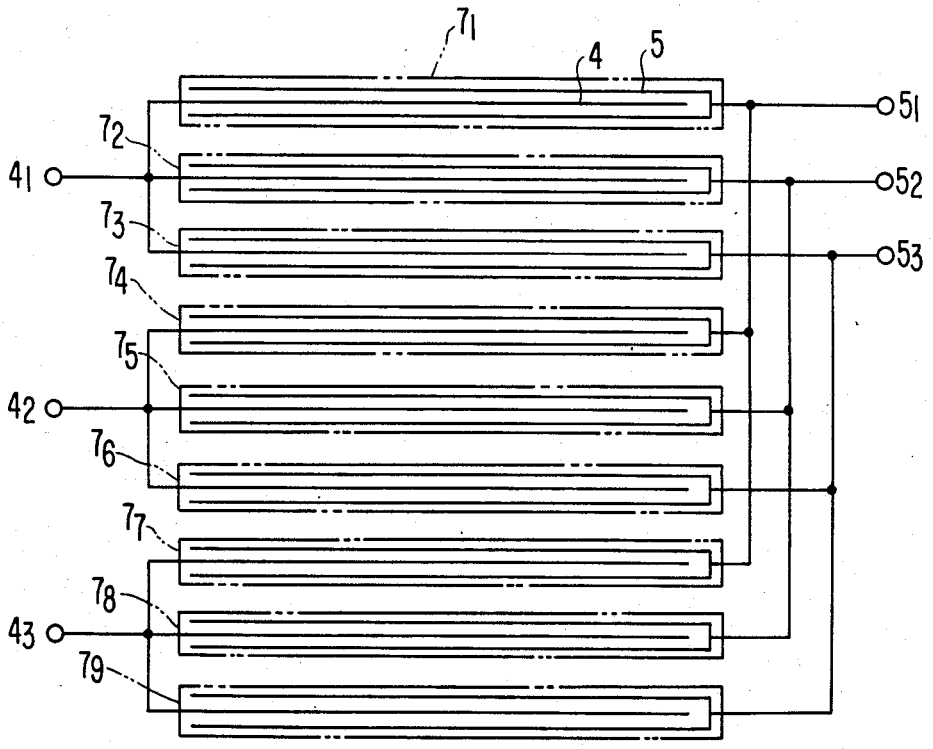
FIG. 2. (PRIOR ART)
FIG. 2 is a schematic, plan view of the electrical connection of the electrodes on the lower substrate of the structure of FIG. 1, oriented at 90° with reference to the view of FIG. 1.

To enable a better appreciation of the improvements and advantages afforded by the multiplex wiring pattern of the present invention, in each of its various embodiments as disclosed herein, there is first described, with reference to FIGS. 1 and 2, a known multiplex wiring circuit for the display electrodes of an AC-driven dot-matrix plasma display panel as disclosed in the Japanese Utility Appication Tokugansho 58-18029, filed by the assignee herein, published as Tokukaisho 59-146021 on Aug. 21, 1984.

FIG. 1 herein is a cross-sectional, elevational view of a portion of the structure of a plasma display panel as disclosed in the referenced Japanese application. The gas discharge display panel 1 of FIG. 1 comprises an upper substrate 1 and a lower substrate 2, on the latter of which are formed a plurality of parallel, main electrodes 4, with each of which there is associated a pair of control electrodes 5 respectively disposed on opposite sides of the corresponding main electrodes 4, extending in parallel therewith and spaced therefrom at a predetermined distance of a few microns, for example. Further, for each main electrode 4 and corresponding pair of control electrodes 5, there is provided a floating electrode 7 formed within an insulating layer 6 which covers the main and control electrodes 4 and 5 and intervenes therebetween, and which as well covers the upper surface of the floating electrode 7. A protection layer 8 is then formed on the surface of the insulating layer 6. As is apparent in FIG. 1, the electrodes 4, 5 and 7 are shown in cross-section, implying that they extend in a Y-direction, normal to the X-direction in the plane of FIG. 1. The panel 1 includes a second glass substrate 3, illustrated as an upper substrate in FIG. 1, on which are disposed a plurality of parallel electrodes 9 extending perpendicularly to the electrodes 4, 5 and 7 of the lower substrate 2, and on the surface of which are formed a second, transparent insulating layer 10 and a second protection layer 11. The protection layers 8 and 11 are spaced so as to define a discharge gap 12 therebetween of a predetermined dimension, the gap 12 being filled with a discharge gas mixture including neon, for example, as a main constituent. Typically, the substrates 2 and 3 are sealed about their peripheral edges so as to confine the discharge gas within the gas gap 12. For the referenced X-direction of the electrodes 4, 5 and 7, the electrodes 9 thus extend in the Y-direction and thus parallel to the plane of the figure; for convenience, they are referred to hereafter as the Y-electrodes 9.

FIG. 2 is a schematic illustration of the electrical configuration of the electrodes 4, 5 and 7 of FIG. 1, for a gas discharge panel having a 9×9-dot matrix display area. Relative to the Y-direction of FIG. 1, the schematic illustration of FIG. 2 corresponds to a plan view of the electrodes 4, 5 and 7 associated with the lower substrate 2, rotated in the view of FIG. 2 by 90° relatively to the view of FIG. 1, such that the X-direction corresponds to a horizontal direction in the view of FIG. 2 and the Y-direction of FIG. 1 corresponds to a vertical direction in FIG. 2. For simplifying the illustration of FIG. 2, the Y-electrodes associated with the upper substrate 3, and which define, with the floating X-direction electrodes 7, the matrix of 9×9 intersections are not shown; however, they will be understood to extend transversely, or perpendicularly, to the electrodes 4, 5 and 7 and thus in the Y-direction, so as to define the matrix of 9×9 intersections therewith, each intersection defining a corresponding discharge cell.

Accordingly, the floating X-direction electrodes 7 of FIG. 1 are illustrated in FIG. 2 as being nine (9) in number, and are designated as the floating electrodes $7_1$–$7_9$, inclusive. Each of the floating electrodes $7_1$–$7_9$ has associated therewith a pair of control electrodes 5 and a corresponding main electrode 4, as specifically designated in FIG. 2 in relation to the floating electrode $7_1$. Each group of three successive main electrodes 4 is connected in common; thus, for the nine (9) main electrodes 4, there are three such groups, of three successive electrodes each, connected in common to respectively corresponding input terminals $4_1$, $4_2$ and $4_3$, the latter being referred to hereinafter as "first" input terminals. On the other hand, the corresponding pairs of control electrodes 5 of the plural groups are connected in common to respectively corresponding input terminals $5_1$, $5_2$ and $5_3$, the latter being referred to hereinafter as "second" input terminals. Thus, each of the floating electrodes $7_1$–$7_9$ is capacitively coupled to its corresponding main electrode 4 and associated pair of control electrodes 5 by respective, predetermined capacitances $C_{74}$ and $C_{75}$.

When a signal voltage $V_2$ is applied to a main electrode 4 (i.e., through the corresponding one of the first input terminals $4_1$, $4_2$ and $4_3$) and a signal voltage $V_3$ is applied to the corresponding pair of control electrodes 5 (through the respectively associated one of the second input terminals $5_1$, $5_2$ and $5_3$), a potential $V_5$ is induced on the corresponding one of the floating electrodes $7_1$–$7_9$ having a value given approximately by the following equation:

$$V_5 \cong (C_{74}V_2 + C_{75}V_3)/(C_{74} + C_{75}) \quad (1)$$

An approximation is made in arriving at equation (1)—namely, that the capacitances $C_{74}$ and $C_{75}$ are each assumed to have a value sufficiently larger than that of the capacitances between the corresponding floating electrode 7 and the Y-direction electrodes 9 on the upper substrate 3 (FIG. 1) such that these latter capacitance values can be ignored.

As seen from equation (1), the potential $V_5$ on a given, floating electrode 7 can be controlled by the voltage $V_2$ applied to the corresponding main electrode 4 and the voltage $V_3$ applied to the associated pair of control electrodes 5. As a further simplification, assuming equal values of the capacitances $C_{74}=C_{75}$ and that voltages $V_2$ and $V_3$ have the same maximum value V, the potential $V_5$ has the following values:

(i) $V_5 = 0$, for $V_2 = 0$ and $V_3 = 0$; (2)
(ii) $V_5 = V/2$, for $V_2 = V$ and $V_3 = 0$;
(iii) $V_5 = V/2$, for $V_2 = 0$ and $V_3 = V$; and
(iv) $V_5 = V$, for $V_2 = V$ and $V_3 = V$.

Relating the approximate voltage relationships expressed in (2) (i)–(iv) to the circuit of FIG. 2, the value, or level, of the respective voltages $V_5$ produced on the floating electrodes $7_1$–$7_9$ will be determined in accordance with the application of a signal voltage level of V or 0 to the pair of first input terminals $4_1$, $4_2$ and $4_3$ and second input terminals $5_1$, $5_2$ and $5_3$ respectively associated with the electrodes $7_1$–$7_9$. For example, when a voltage V is applied selectively to the first input terminals $4_1$ and $5_1$ while the remaining first and second input terminals are maintained at 0, the voltage level on each of the floating electrodes $7_2$, $7_3$, $7_4$ and $7_7$ is V/2 and that on the remainder of the floating electrodes (i.e., $7_5$ and $7_6$) is 0 volts. Thus, by applying the voltage V to a selected one of the first input terminals $4_1$, $4_2$ and $4_3$ and to a selected one of the second input terminals $5_1$, $5_2$ and $5_3$, a specific, individual one of the floating electrodes $7_1$–$7_9$ is driven by the voltage V. Accordingly, the floating electrodes $7_1$–$7_9$ may be selected individually to be driven with the voltage V.

The multiplex wiring circuit of FIG. 2 thus requires only six (6) driving circuits for controlling the voltages applied to the first input terminals $4_1$, $4_2$ and $4_3$ and the second input terminals $5_1$, $5_2$ and $5_3$ whereas a conventional dot-matrix panel would require nine (9) driving circuits for the corresponding nine (9) individual electrodes, achieving a reduction by three (3). The use of floating electrodes, each of which is capacitively coupled to a respectively corresponding main electrode and an associated pair of control electrodes in accordance with the foregoing description, is referred to as a multiplex wiring, or connection, of the display electrodes of an AC-driven dot-matrix plasma display panel, in the following.

The voltage difference required for producing a gaseous discharge between a selected X-electrode and a selected Y-electrode, defining a given discharge cell, is referred to as the firing voltage, $V_F$. Accordingly, when the difference between the voltage applied to a selected, floating electrode $7_1$–$7_9$, which is selectively addressed in accordance with the multiplex wiring circuit above-described, and the voltage applied to a selected one of the Y-direction electrodes 9 exceeds the firing voltage $V_F$, a gas discharge will occur at the corresponding intersection. Expressed with reference to the voltage level relationships set forth above in equation (2), if the voltage on a selected one of the X-electrodes $7_1$–$7_9$ (i.e., the floating electrodes 7) is V and the voltage applied to a selected Y-electrode 9 (FIG. 1) is equal to or lower than $V-V_F$, a discharge will be produced at the corresponding intersection, or discharge cell. At this time, the voltages on the remaining X-electrodes $7_1$–$7_9$ are either V/2 or 0 volts, as set forth in the above relationships 2(i), (ii) and (iii); hence, no discharges will occur at the intersections of the remaining X-electrodes $7_1$–$7_9$ with the selected, subject Y-electrode 9, so long as the voltage on the latter (i.e., the selected Y-electrode) is greater than $V_2-V_F$.

When data has already been written into the display panel such that discharges at the appropriately addressed intersections are being maintained (i.e., the corresponding discharge cells are "on"), such existing discharges may be extinguished thereby erasing the entirety of the displayed information and then, new data may be written into the panel in the manner described above; alternatively, only the discharges at the intersections corresponding to displayed data which is to be altered may be extinguished and new data then may be written into the display at the appropriate, currently non-discharging intersections, thereby not disturbing the discharges at yet other intersections which are displaying data which is intended to be continued. An exemplary driving method for such a plasma display panel having multiplex wired electrodes is disclosed by the same inventors as herein, in U.S. patent application Ser. No. 678,677, filed Dec. 5, 1984.

As described above, and with reference to the simplified schematic example in FIG. 2 of a 9×9 dot-matrix panel, the use of multiplex wiring of the electrodes permits reducing the number of driver circuits, relative to the number of display electrodes. The reduction is more significant, when considered in relation to a practical panel having a large number of electrodes. For example, in a panel having 512 X-electrodes, the minimum number of necessary driver circuits is 48; for a panel having 1,024 X-electrodes, the minimum number of required driver circuits is 64. In principle, multiplex wiring does not affect the speed of operation of the plasma display panel (i.e., the addressing speed), at least in principle, if employed with only either the X-electrodes or the Y-electrodes.

A plasma display panel having the structure and multiplex wiring arrangements of FIGS. 1 and 2 as discussed hereinabove introduces problems, however, both in the difficulty of fabricating same and in the low levels of productivity, or yield, which are experienced in practice. This arises from the extreme precision required in the alignment of the floating electrodes 7 and the corresponding main electrodes 4 and respectively associated pairs of control electrodes 5. Specifically, the main and control electrodes 4 and 5 must be formed in precise alignment so as to be parallel with each other and in uniform, vertically spaced and aligned relationship with the floating electrodes 7, and thus in uniform, insulated relationship therewith; moreover, each of the floating electrodes 7 must have a width of about 0.2 mm or less, and a length of about 100 mm or more. Thus, while the multiplex wiring circuit of the prior application has permitted a significant reduction in the number of driver circuits, it introduces new problems in the context of the complexities of fabrication and the reduced yield of the fabricated circuit structures. Accordingly, there is a continuing need for an improved form of multiplex wiring circuits for use with plasma display panels of the dot-matrix, AC-driven type. The multiplex wiring circuit in accordance with the present invention achieves significant improvements, affording reduced complexity of the fabrication processes and thus contributing to improved yield of the resulting, fabricated circuit structures having improved operating characteristics.

Figure 3:
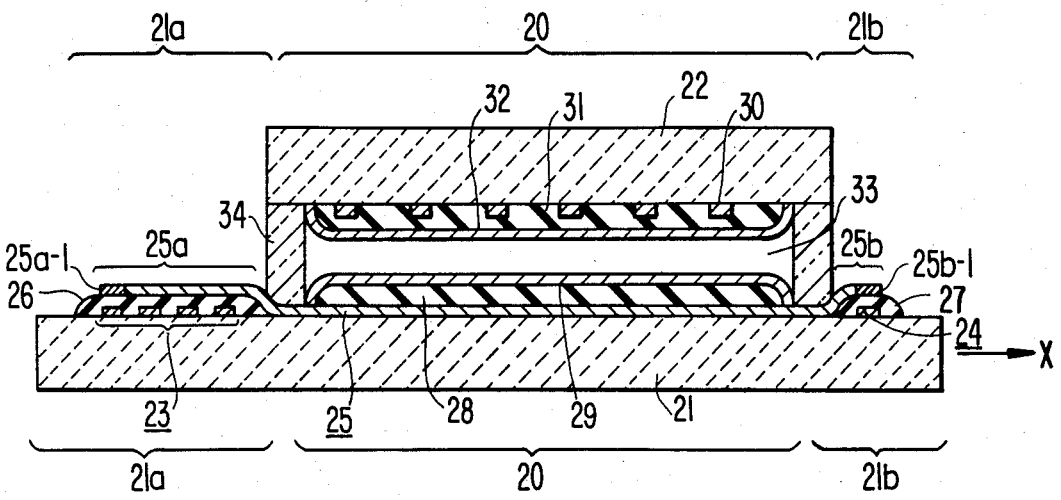
FIG. 3 is an elevational view, partially in cross-section, of a gas discharge display panel in accordance with a first embodiment of the present invention.

FIG. 3 is a simplified elevational view, partially in cross-section, of a gas discharge display panel incorporating a first embodiment of a multiplex wiring pattern for the display electrodes thereof, in accordance with the present invention. First and second supporting substrates 21 and 22, at least one of which must be transparent and both typically comprising glass plates of structure and material well known in the art, support respective groups of display electrodes relatively oriented in transverse relationship so as to define spatial intersections comprising a matrix of display dots in the display area 20. To facilitate an understanding of the structure of FIG. 3, reference will be had concurrently to the plan view of FIG. 4, which illustrates the structure of the lower substrate 21 and the electrodes formed thereon. In correlating FIGS. 3 and 4, the X-direction is illustrated to lie in the plane of FIG. 3 and to extend horizontally therein, whereas the plan view of FIG. 4 effectively is rotated 90° such that the X-direction is in a vertical orientation and the Y-direction is in a horizontal orientation; it follows that the Y-direction is transverse to the plane of FIG. 3.

With concurrent reference to FIGS. 3 and 4, the lower substrate 21 has formed thereon a first plurality of generally parallel, X-direction display electrodes 25 which, as later detailed, are organized in repeating groups of four; illustratively, a first such group includes the successive display electrodes 25-1, 25-2, 25-3 and 25-4. In view of the greater length of electrode 25-1 and the common thickness of all of the display electrodes 25, it will be apparent that only the first display electrode 25-1 out of the plurality of the display electrodes 25 is visible in FIG. 3.

The substrate 21 includes a first peripheral portion **21*a* and second peripheral portion 21*b* which respectively extend in the X-direction beyond the opposite, first and second edges of the display area 20 and thus in the same direction as the orientation of the display electrodes 25. The first peripheral portion 21*a* has formed thereon a first plurality of generally parallel driving electrodes 23, as illustrated in FIG. 4 by the individually designated electrodes 23-1, 23-2, 23-3 and 23-4, and which are oriented in the Y-direction and thus extend transversely to the first plurality of display electrodes 25. The electrodes 23-1–23-4 are of a common length, sufficient to traverse the entirety of the display electrodes 25. The second peripheral portion 21*b* has formed thereon a plurality of aligned, second driving electrodes 24, illustrated in FIG. 4 by the individually designated electrodes 24-1, 24-2, 24-3 and 24-4. The electrodes 24-1, 24-2, 24-3 and 24-4 are of a common length, sufficient to traverse the respective groups of display electrodes 25 associated therewith, as is apparent from FIG. 4**.

As best seen in FIG. 3, the first plurality of driving electrodes 23 is covered by an insulating layer 26 and the second group of driving electrodes 24 is covered by a corresponding insulating layer 27. Within the display area 20, furthermore, an insulating layer 28 is formed on the surface of the first plurality of display electrodes 25 and a protection layer 29 is formed over the insulating layer 28. With regard to the upper substrate 22, a plurality of Y-direction display electrodes 30 is formed so as to extend tranversely to the first plurality of display electrodes 25 and thereby define corresponding spatial intersections therebetween; a second insulating layer 31 is formed over the second plurality of display electrodes 30 and a second protection layer 32 is formed over the second insulating layer 31. The exposed surfaces of the composite structures associated with the respective lower and upper substrates 21 and 22, as defined by the respective protection layers 29 and 31, are spaced apart so as to define a discharge gas gap 33, which is filled with a suitable discharge gas. The lower and upper substrates 21 and 22 furthermore are maintained in their spaced, structural relationship, and the gas gap 33 furthermore is sealed, by a sealing layer 34, represented as vertical sidewalls and which extends about the entirety of the periphery of the display area 20 between the two substrates 21 and 22. A typical discharge gas employed in the gas gap 33 is a neon argon (Ne-Ar) gas mixture of a type well known in the art.

Each of the display electrodes 25 is connected at its first and second, opposite ends to respectively associated ones of a first plurality of coupling electrodes **25*a* and a second plurality of coupling electrodes 25*b*, which capacitively couple same to respectively corresponding ones of the first and second pluralities of driving electrodes 23 and 24. As shown more specifically in FIG. 4, the first plurality of coupling electrodes 25*a* comprises a repeating pattern, or sequence, of coupling electrodes 25*a*-1, 25*a*-2, 25*a*-3 and 25*a*-4, which respectively overlie, or are aligned with, the corresponding first driving electrodes 23-1, 23-2, 23-3 and 23-4 and are commonly spaced therefrom by the insulating layer 26 so as to be capacitively coupled thereto. The display electrodes 25-1 to 25-4 include extensions beyond the display area 20 for connecting the first ends thereof to the first coupling electrodes 25*a*-1 to 25*a*-4, respectively, and for connecting the opposite, second ends thereof to the aligned, second coupling electrodes 25-1–25-4**, respectively.

Because of the capacitive coupling afforded between the respective first and second coupling electrodes **25*a* and 25*b* and the respective first and second pluralities of driving electrodes 23 and 24, there is no need to provide through-holes extending through the insulating layer 26. Furthermore, a significant advantage over the floating electrode structure of FIG. 1 afforded by this embodiment of the present invention, is that the display electrodes 25 within the display area 20 need not perform any role as the electrode of a coupling capacitor in the fabrication of the multiplex wiring circuit, as in the case of the floating electrodes 7 in the circuit of FIG. 1, since the capacitive coupling function is performed by the respectively associated first and second coupling electrodes 25*a* and 25*b* and first and second driving electrodes 23 and 24, which are fabricated in the corresponding first and second peripheral portions 21*a* and 21*b* of the first substrate 21 and lie outside the display area 20. The driving electrodes 23 and 24 and the coupling electrodes 25*a* and 25*b* thus may have dimensions on the order of a few millimeters—by contrast, the display electrodes 25, at least in those portions lying within the display area 20, typically are of a width on the order of 0.2 mm. Again, by comparison to the structure of FIG. 1 in which the floating electrode 7 must afford the display function of the display electrodes 25 in FIGS. 3 and 4, it will readily be seen that the aforedescribed problems attendant fabrication of the floating electrode structure of FIG. 1, are eliminated by the multiplex circuit structure in accordance with the present invention, as shown in FIGS. 3 and 4**.

Figure 4:
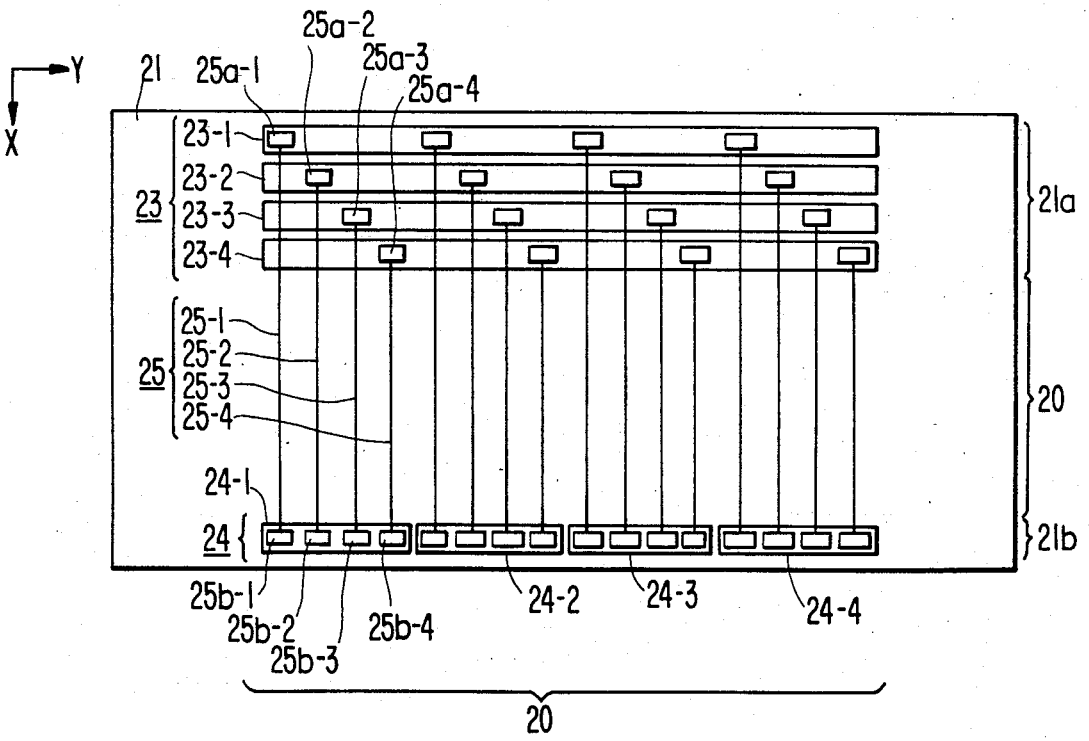
FIG. 4 is a schematic, plan view of the electrical connection of the electrodes on the lower substrate of the structure of FIG. 3, oriented at 90° with reference to the cross-section of FIG. 3.

The schematic plan view of FIG. 4 illustrates only sixteen (16) display electrodes 25, for simplicity of illustration. Further, for this simplified illustration, the plurality of X-direction display electrodes 25 has been organized in four (4) successive groups with a corresponding, repeating pattern of four (4) successive electrodes in each group. As shown for a first such group, the electrodes 25-1, 25-2, 25-3 and 25-4 are capacitively coupled at their first ends to the respectively corresponding first driving electrodes 23-1, 23-2, 23-3 and 23-4, and are capacitively coupled at their second ends in common to the second driving electrode 24-1. That pattern then is repeated for each successive group of display electrodes. It is believed apparent that the number of parallel, first driving electrodes 23 may be increased and correspondingly the number of display electrodes 25 within each group would be increased, and as well as that the increased number of electrodes of each group would be capacitively coupled in common to the corresponding one of the second driving electrodes 24. Thus, the specific illustration of FIG. 4 is not intended as limiting in any respect. It is to be appreciated, as well, that the illustration of only six (6) Y-direction display electrodes 30 in FIG. 3 again is for purposes of simplicity in illustration. While other groupings of the first and second coupling electrodes 25*a* and 25*b* with the first and second driving electrodes 23 and 24 are possible, the structural organization as illustrated in FIG. 4 and the resulting multiplex addressing mode thereby afforded is believed most advantageous, for reducing the number of crossover points of the driving electrodes 23 and the electrical interconnections between the coupling electrodes 25*a* and the corresponding display electrodes 25.

Driving circuits for use with the circuit of FIG. 4 may be of conventional type, and thus are not illustrated herein. Nevertheless, it is believed apparent that an individual driver circuit is to be associated with each of the plurality of driving electrodes 23 and each of the plurality of driving electrodes 24. Thus, whereas a conventional system would require sixteen (16) driver circuits, one for each of the sixteen (16) display electrodes 25, the multiplex wiring of the display electrodes 25 as disclosed in FIGS. 3 and 4 permits reducing that total number of required driver circuits to eight (8)—i.e., one for each of the driving electrodes 23 and 24, as before specified. The multiplex wiring circuit of the invention thus affords a significant reduction in the number of driving circuits required, as compared with conventional systems.

Further, as before noted, whereas the structure of FIG. 3 illustrates use of the multiplex wiring circuit of the invention only for the X-direction display electrodes 25, the same multiplex wiring circuit may be provided for the Y-direction display electrodes 30 of the upper substrate 22, with corresponding extensions of the latter for affording peripheral portions to accommodate same, as in the case of substrate 21. Thus, the multiplex wiring circuit of the invention may be employed for both the X-direction display electrodes 25, as shown, and as well for the Y-direction display electrodes 30. Assuming such a structure to be implemented, and letting N and M represent the numbers of the X-direction display electrodes 25 and the Y-direction display electrodes 30, respectively, and letting n and m represent the minimum integers equal to or larger than the respective roots of N and M, the respective, minimum number of driver circuits for driving X-direction and Y-direction display electrodes in accordance with the multiplex wiring circuit of the present invention can be expressed as approximately the sum of 2n and 2m—with an error of less than 10% for N and M larger than 30.

Figure 5:
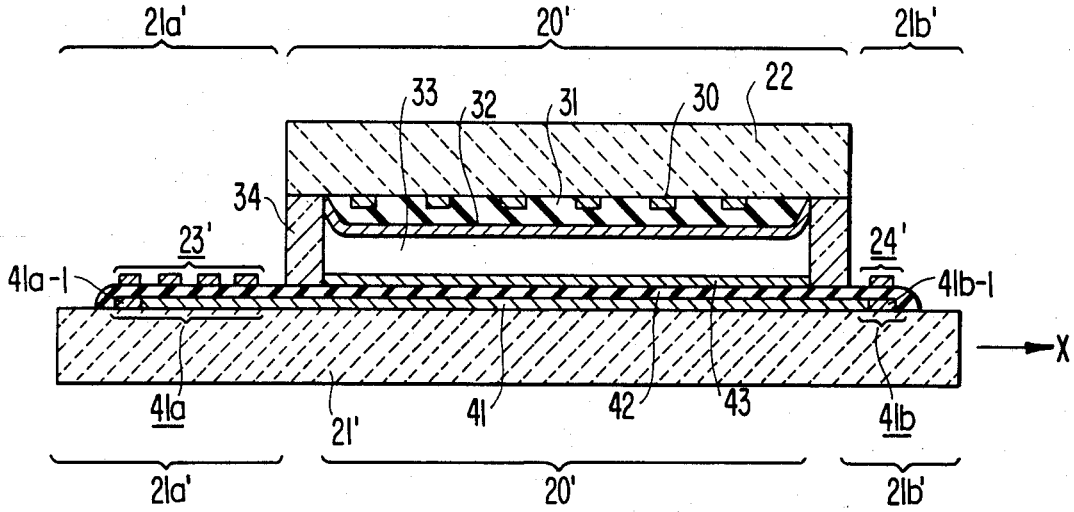
FIG. 5 is an elevational view, partially in cross-section, of a gas discharge display panel in accordance with a second embodiment of the present invention.

FIG. 5 is an elevational view, partially in cross-section, of a gas discharge display panel in accordance with a second embodiment of the present invention. While certain elements in the embodiment of FIG. 5 are the same as corresponding elements in the embodiment of FIG. 3 and accordingly are identified by corresponding reference numerals, a significant difference in the embodiment of FIG. 5 is that extensions of the display electrodes and the corresponding coupling electrodes are formed directly on the surfaces of the peripheral portions of the substrate and a common insulating layer is formed thereover, with the driving electrodes formed thereon. This structure permits simplification of the fabrication steps for forming the structure, as will become apparent.

Accordingly, the embodiment of FIG. 5 again employs a lower substrate 21' having peripheral, extended portions 21*a'* and 21*b'*, and an upper substrate 22 on which Y-direction electrodes 30 are formed, the latter covered by an insulating layer 31 and a protection layer 32, in sequence. The upper substrate 22 is sealed at 34 to the lower substrate 21' so as to define a gas gap 33 which is filled with a discharge gas.

The structure of FIG. 5 is different from that of FIG. 3, in that the plural X-direction display electrodes 41 (of which only one is seen in the cross-sectional view of FIG. 5) are formed in closely spaced, parallel relationship on the surface of the lower substrate 21' in the display area 20' and each of which extends therebeyond, directly on the peripheral portions 21*a'* and 21*b'*. An insulating layer 42 is formed over the display electrodes 41, extending as a continuous, uniform and planar layer throughout the display area 20' and onto the peripheral portions 21*a'* and 21*b'* of the lower substrate 21'; a protection layer 43 then is formed on the insulating layer 42, at least within the display area 20'. The first and second pluralities of driving electrodes 23' and 24' then are formed on the surface of the insulating layer 42 in the peripheral portions 21*a'* and 21*b'*, thereby to be capacitively coupled to corresponding ones of the first and second pluralities of the coupling electrodes 41*a* and 41*b* on the peripheral portions 21*a'* and 21*b'*, respectively, of the substrate 21', which in turn are connected to corresponding, opposite ends of the display electrodes 41. The configuration, or pattern, of the wiring of the plurality of display electrodes 41 and the respectively associated coupling electrodes 41*a* and 41*b* and driving electrodes 23' and 24' in FIG. 5, corresponds substantially to that shown in FIG. 4 for the display electrodes 25, the coupling electrodes 25*a* and 25*b*, and the driving electrodes 23 and 24, respectively, and correspondingly affords multiplex wiring of the display electrodes 41.

Thus, the embodiment of FIG. 5 provides in the display area 20', a plurality of spatial intersections between the first plurality of X-direction display electrodes 41 and the transversely extending, second plurality of Y-direction display electrodes 30, defining corresponding discharge cells which may be selectively addressed to produce selective discharges, as in FIG. 4. The multiplex wiring structure of FIG. 5 retains the advantage of that of FIG. 4, in permitting the use of a reduced number of driving circuits, relatively to the number of display electrodes 41. An advantage of the structure of FIG. 5 over that of FIG. 4 is that the single insulating layer 42 performs the function of the separate insulating layers 26, 27 and 28 of the structure of FIG. 3, and thus may be formed by a simplified manufacturing process. Particularly, as is apparent from FIG. 3, the insulating layers 26 and 27 must be formed after deposition of the driving electrodes 23 and 24 and independently of the formation of the insulating layer 28 covering the display electrodes 25. By contrast, the structure of FIG. 5 enables a single deposition of the display electrodes 41 and the coupling electrodes 41*a* and 41*b*, and the extensions of the former for connection to the latter, and then a single deposition of the insulating layer 42 thereover. Similarly to the structure of FIG. 3, in FIG. 4 the upper substrate 22 and associated display electrodes 30 may be formed, in the alternative, to include multiplex wiring of the display electrodes 30, as shown for the lower substrate 21' in FIG. 5 or the lower substrate 21 in FIG. 3.

As before noted, the capacitances between the respectively associated driving electrodes and coupling electrodes must be significantly larger than the capacitances between each X-direction display electrode and the plurality of Y-direction display electrodes which interesect therewith. This relationship is further discussed with reference to FIGS. 6*a* which comprises a schematic, equivalent circuit representation of the capacity distribution between a given X-direction display electrode 51 and a plurality of Y-direction display electrodes $Y_1, Y_2, \ldots Y_n$ which intersect same, and FIG. 6*b* which comprises an equivalent electrical circuit diagram of a discharge cell $C_g$, as defined by an individual intersection of an X-direction display electrode and a Y-direction display electrode, forming an individual display dot of the array thereof in a panel With more specific reference to FIG. 6*a*, the X-direction display electrode 51 is coupled capacitively to driving electrodes 52 and 53 through respective capacitors $C_{11}$ and $C_{12}$. The X-direction display electrode 51 spatially intersects a plurality (n) of Y-direction display electrodes $Y_1, Y_2, \ldots Y_n$. The spatial intersections of the X- and Y-direction electrodes define respectively corresponding capacitances $C_{21}, C_{22}, \ldots C_{2n}$, each comprising the serially connected capacitance components $C_{30x}$, $C_g$ and $C_{30y}$ as illustrated in the equivalent circuit of FIG. 6*b*. More particularly, the capactances $C_{30x}$ and $C_{30y}$ are the electrical circuit equivalents of the capacitances presented by the respective insulating layers covering the X- and Y-direction display electrodes (e.g., the insulating layers 28 and 31 in FIG. 3) and $C_g$ is the equivalent electrical circuit capacitance established by the gas discharge space or gap (e.g., the gap 33 in FIG. 3). It is apparent, therefore, that the values of $C_{30x}$, $C_g$ and $C_{30y}$ are determined, approximately, as a function of the area of the spatial intersections of the X- and Y-direction display electrodes. Typically, a given discharge cell has a symmetrical structure and defines a discharge gas gap which is comparable in electrical capacitance characteristics to that of the first and second insulating layers (i.e., taking into account the material and thickness thereof), which cover the respective X- and Y-direction electrodes defining the cell. Hence, the relationship of the capacitances of FIG. 6*b* may be expressed as:

$$C_{30x}=C_{30y}\cong kC_g \tag{3}$$

where k is a constant determined in accordance with the gap dimension and the material and thickness of the insulating layer, usually having a value of about 100.

Figure 6A:
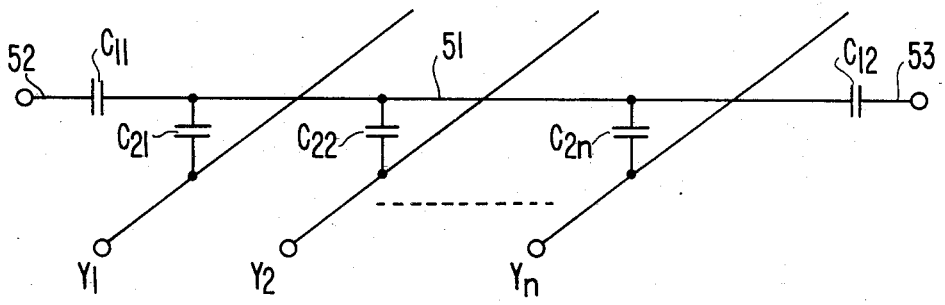
FIG. 6*a* is an equivalent, electrical circuit schematic representation illustrating the distribution of capacitances between intersecting X-direction and Y-direction display electrodes of a plasma display panel.

In order that the respective driving voltages applied to the driving electrodes 52 and 53 for a given X-direction electrode 51, and to a selected Y-direction display electrode, for example the display electrode $Y_1$ in FIG. 6*a*, are effectively distributed to as great an extent as possible to the corresponding, selected discharge cell, represented in this instance by the capacitance $C_{21}$, the values of the capacitances $C_{11}$ and $C_{12}$ must be significantly larger than the total capacitance value of the plurality of equivalent capacitances of the discharge cells $C_{21}, C_{22}, \ldots C_{2n}$, preferably by a factor of five (5) or more. The fact that this requirement may be achieved on the circuit structure of the present invention is explained in the following.

Figure 6B:
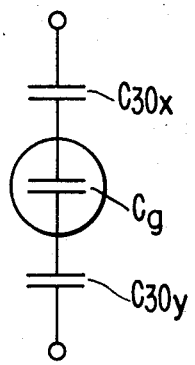
FIG. 6*b* is an equivalent, electrical circuit schematic representation of a discharge cell corresponding to an individual display dot of a dot-matrix display, or array.

With regard to the equivalent electrical circuit of FIG. 6*a*, let it be assumed that: (a) the number (n) of the Y-direction display electrodes $Y_1, Y_2, \ldots Y_n$ is 200, and thus $n=200$; (b) the capacitance values of the coupling capacitors $C_{11}$ and $C_{12}$ are the same; (c) all discharge cells as defined by the intersections of the X-direction display electrode 51 and all of the associated Y-direction display electrodes $Y_1, Y_2, \ldots Y_n$ are undergoing discharge; and (d), in view of assumption (c), the capacitance values are the same for all of the capacitors $C_{21}, C_{22}, \ldots C_{2n}$. Under these assumptions, the requirement for the relationship of the capacitances, as set forth above, may be expressed:

$$C_{11}=C_{12}\geqq 5C_0=1{,}000C_{21}\cong 500C_{30x} \tag{4}$$

where $C_0$ represents the total capacitance of capacitors $C_{21}, C_{22}, \ldots C_n$, and $C_{30x}(=C_{30y})$ represents the capacitance value of the insulating layer, as explained with reference to FIG. 6*b*. In view of the relationship established in equation (4), therefore, $C_{11}$ and $C_{12}$ must be 500 times greater than the capacitance of the insulating layers covering the X- and Y-direction display electrodes.

With reference to the structure of FIG. 5 as an example, and in relation to the equivalent electrical circuit of FIG. 6*a*, the dielectric layers of the coupling capacitors $C_{11}$ and $C_{12}$ are provided by the corresponding portions of the insulating layer 42 disposed between the first and second driving electrodes 23' and 24' and the respectively associated first and second extensions of the X-direction display electrode 41. Thus, from equation (4), the area of the coupling electrodes 41*a* and 41*b* in FIG. 5 (and, correspondingly, the coupling electrodes 25*a* and 25*b* in FIG. 4) must be 500 times larger than that of the total area of the spatial intersections between a given X-direction display electrode, such as display electrode 41 in FIG. 5, and the associated Y-direction display electrodes which intersect therewith, shown as Y-direction display electrodes 30 in FIG. 5 and, more generally, as the Y-direction display electrodes $Y_1, Y_2, \ldots Y_n$ in FIG. 6*a*. For a typical gas discharge panel having intersecting X- and Y-direction display electrodes, as in FIGS. 3 and 5, the typical width of each display electrode is 0.07 mm; accordingly, the area of the spatial intersection between a given X-direction display electrode and given Y-direction display electrode is about 0.005 $mm^2$. Therefore, to satisfy equation (4), and for n=200, the area required for each coupling electrode (i.e., $C_{11}=C_{12}$) is approximately 2.5 $mm^2$. An area of 2.5 $mm^2$ for each of the coupling electrodes is reasonable, in view of their being formed in the peripheral substrate portions 21*a* (21*a*') and 21*b* (21*b*') in FIG. 3 (5).

Thus, practical and useful plasma display panels having multiplex wiring of the display electrodes may be achieved in accordance with the structures illustrated in FIGS. 3 and 5. Significantly, however, an assumption underlying the foregoing analysis is that the number (n) of the Y-direction display electrodes was n=200. As that number (n) increases substantially above n=200, certain additional factors must be taken into account.

One such factor—neglected in the foregoing analysis—is the effect of the capacitances formed on the crossovers of the coupling electrodes and the extensions of the display electrodes which connect to the corresponding coupling capacitors. For example, in FIG. 4, the extension of the display electrode 25-1 beyond the display area 20 and over the insulating layer 26 for connecting to the coupling electrode 25*a*-1 crosses over the driving electrodes 23-2, 23-3 and 23-4, establishing respective capacitances therebetween; this may be readily visualized from the elevational view of FIG. 3. As the number of driving electrodes 25 in a given group increases, in accordance with increases in the number of display electrodes, the corresponding increase in the total capacitance of such crossovers—and the resultant voltage drop of the driving voltages ultimately applied to the display electrodes—cannot be neglected. This phenomenon may be considered as a type of cross-talk between the driving electrodes; for example, a low voltage or ground level driving voltage applied to the nonselected driving electrodes may effectively appear on the selected display electrode.

A further factor is that with increases in the number of display electrodes, the number of coupling electrodes and the number of driving electrodes as well increase, but in the pitch (i.e., center to center spacing) of the display electrodes generally is reduced. As a result, it is difficult to provide the required area in the peripheral portions of the substrate for the coupling electrodes, consistent with the above discussed relationship.

Figure 9:
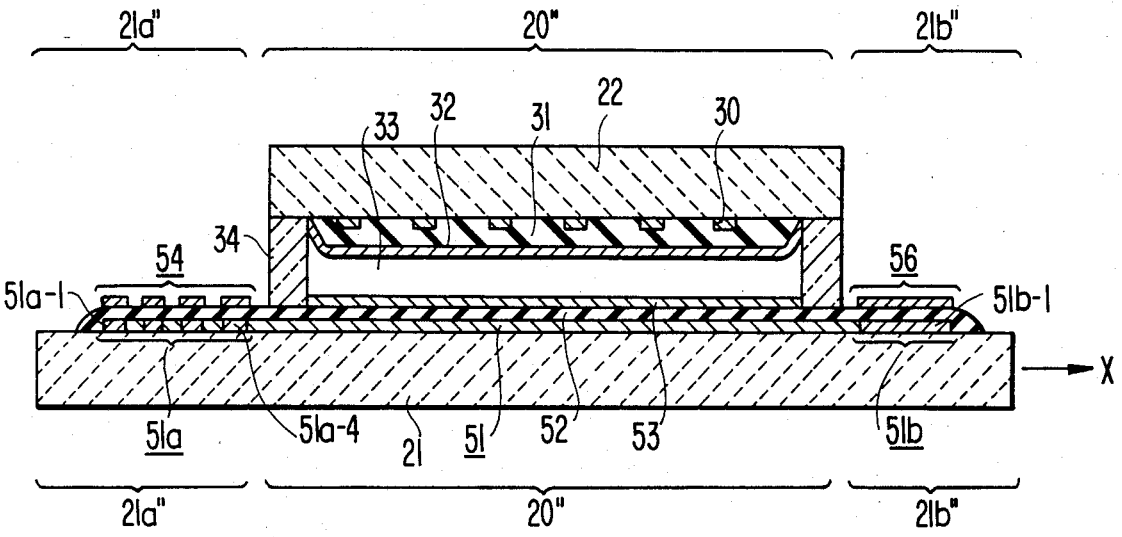
FIG. 9 is a simplified, elevational view, partially in cross-section, of a gas discharge display panel in accordance with the third embodiment of the present invention, employing the electrode patterns therefor as shown in FIGS. 7 and 8.
Figure 7:
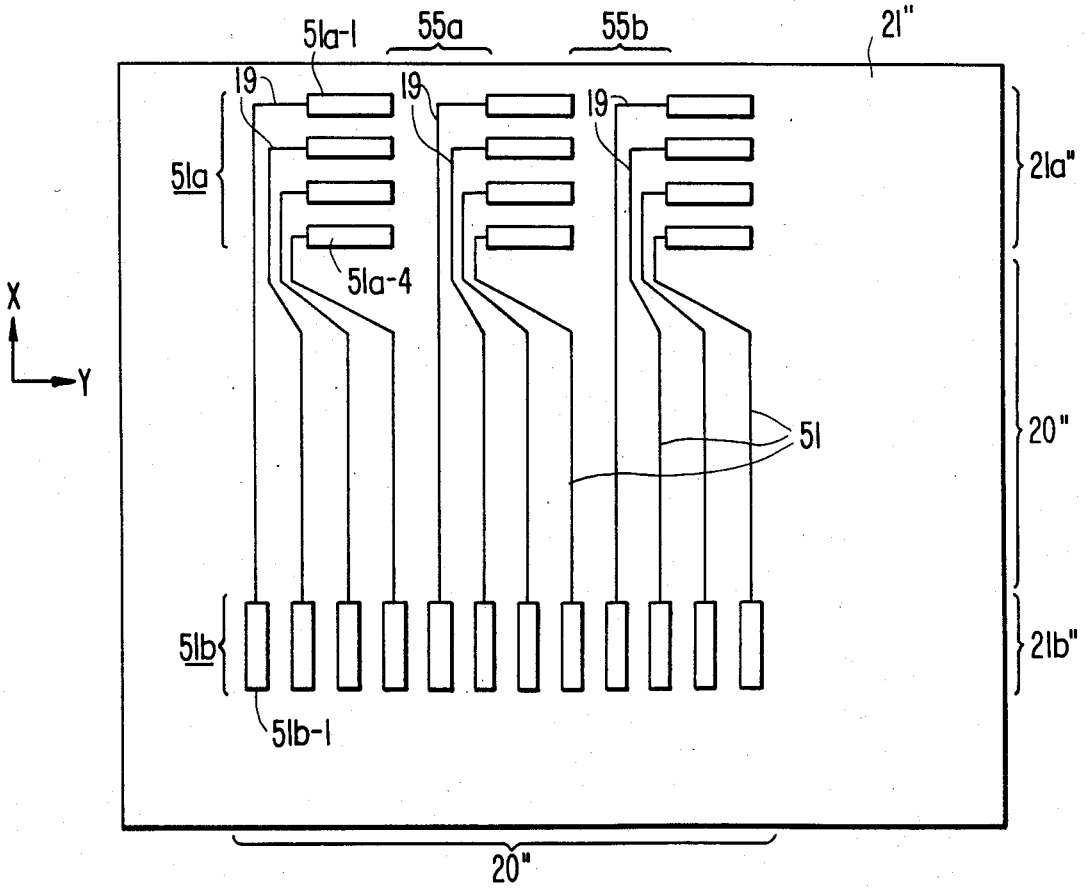
FIG. 7 is a simplified, plan view of an exemplary pattern of display electrodes and corresponding coupling electrodes of a gas discharge display panel in accordance with a third embodiment of the present invention.
Figure 8:
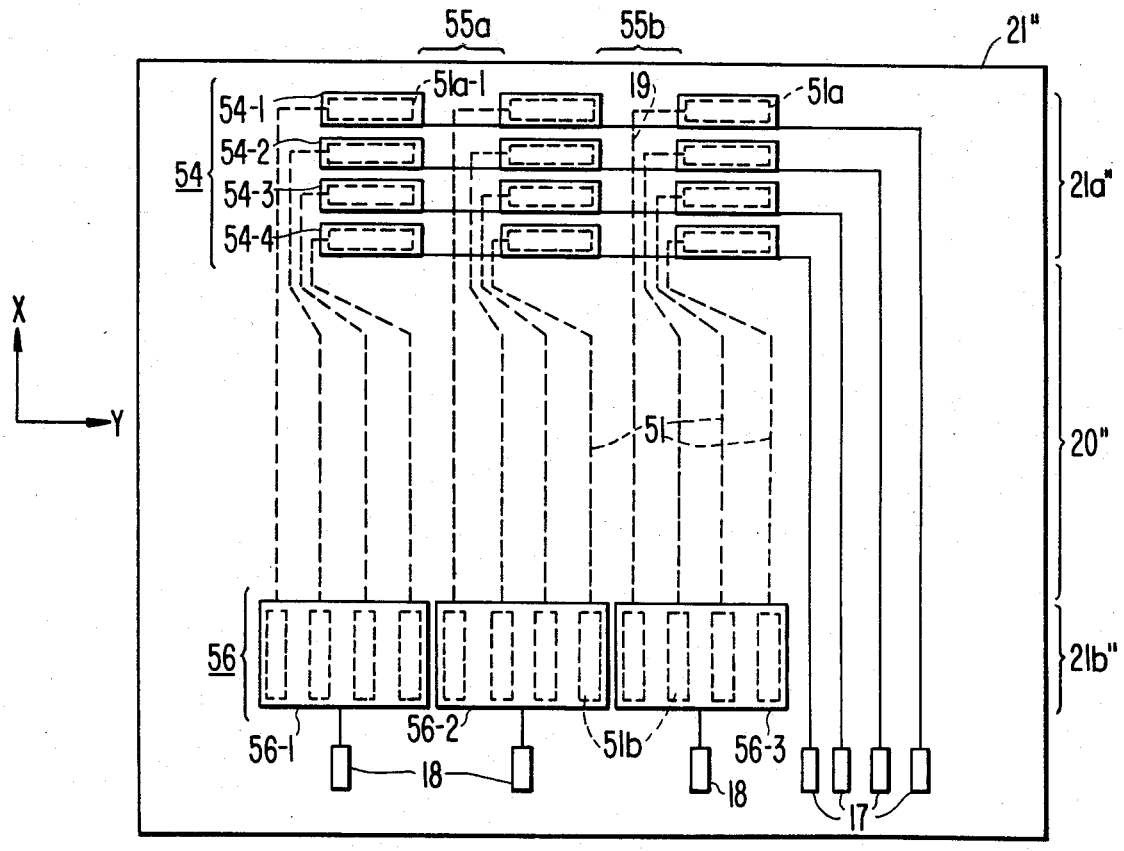
FIG. 8 is a plan view of an exemplary pattern of driving electrodes formed in combination with the display and coupling electrode pattern of FIG. 7 in accordance with the third embodiment of the invention.

These factors present problems which, however, can be overcome by the multiplex wiring and related electrode pattern of a plasma display panel in accordance with the third embodiment of the present invention illustrated in FIGS. 7 to 9. In FIG. 7, X-direction display electrodes 51, shown as twelve (12) in number for illustrative purposes, are formed on a substrate 21", extending in parallel relationship through the display area 20" and being connected at respective, opposite ends thereof to corresponding ones of a first plurality of coupling electrodes 51*a* formed on a first peripheral portion 21*a*", and to corresponding ones of a second plurality of coupling electrodes 51*b* formed on a second peripheral portion 21*b*" of the substrate 21". The twelve (12) X-direction display electrodes 51 are arranged in three (3) groups of four (4) electrodes each. Likewise, the first coupling electrodes 51*a* are arranged in three (3) groups of four (4) coupling electrodes each. The display electrodes 51 accordingly extend beyond the display area 20" for connection through respectively corresponding interconnections 19 to the corresponding first coupling electrodes 51*a* in the respective groups thereof. As is apparent from FIG. 7, the individual first coupling electrodes 51*a* extend transversely, and thus in the Y-direction, relative to the X-direction of the display electrodes 51. Each of the interconnections 19 includes a first portion extending in parallel relationship in the X-direction with a pitch smaller than that of the display electrodes 51 within the display area 20", and a second, right angle portion extending in the Y-direction completing the connection to the respective coupling electrode 51*a*. On the opposite peripheral portion 21*b*" of the substrate 21", the second plurality of coupling electrodes 51*b* is aligned, relative to the narrow dimension of each, in the Y-direction (with the longer dimensions thereof in parallel relationship in the X-direction) and connected to respective ones of the display electrodes 51. As in the prior plasma display panel configurations, for example, in FIGS. 3 and 5, an insulating layer (not shown) then is formed over the electrodes.

In FIG. 8, the electrode pattern of FIG. 7 is illustrated in dotted lines, it being understood moreover that the insulating layer above referenced (not shown) is formed thereover. First and second pluralities of driving electrodes 54 and 56 then are formed on the surface of the insulating layer (not shown) in association with the respective first and second pluralities of coupling electrodes 51*a* and 51*b*. More specifically, the individual driving electrodes 54-1, 54-2, 54-3 and 54-4 of the first plurality of driving electrodes 54 extend in parallel in the Y-direction; moreover, each is of segmented form so as to include narrow portions in the regions 55*a* and 55*b* which cross over the underlying interconnections 19. As specifically identified in FIG. 8, therefore, the segmented, first driving electrode 54-1 includes a segment of normal width overlying the corresponding uppermost coupling electrode 51*a* in each of the three successive groups thereof, but is narrowed in the regions 55*a* and 55*b* which cross over the interconnections 19 formed on the underlying substrate 21". (It will be recalled that an insulating layer is formed over the entirety of the electrode pattern of FIG. 7 and insulates the driving electrodes 54 and 56 therefrom.) Thus, in the structure of FIG. 8, the capacitances formed by the crossovers of the first driving electrodes 54 and the interconnections 19 are significantly reduced, in comparison to the structures of FIGS. 4 and 5.

The second plurality of driving electrodes 56 is formed on the second peripheral portion 21*b*" of the substrate 21", extending in aligned relationship in the Y-direction, as before noted, each of the individual, second driving electrodes 56-1, 56-2 and 56-3 being capacitively coupled through the intervening insulating layer (not shown) to all of the four (4) coupling electrodes 51*b* of the associated group.

Further, the first plurality of driving electrodes 54 is connected to respectively corresponding ones of a first plurality of input terminals 17 and the second plurality of driving electrodes 56 is connected to respective ones of a second plurality of input terminals 18; external voltages thus may be applied conveniently to the input terminals 17 and 18 for driving the panel.

The substrate 21" having the multiplex wiring and associated electrode pattern thereon, as in FIG. 8, then may be assembled into a plasma display panel as shown in the elevational and partly cross-sectional view of FIG. 9. The elevational view of FIG. 9 is oriented relatively to the plan view of FIGS. 7 and 8 in the same sense as the elevational view of FIG. 3 relates to the plan view of FIG. 4, hereinabove described. Thus, the lower substrate 21'' includes a display area 20'' and peripheral portions 21a'' and 21b'' extending beyond the opposite edges of the display area 20''. The display electrodes 51 thus have portions extending in parallel relationship in the X-direction in the display area 20''. The display electrodes 51 extend beyond a first edge of the display area 20'' for connection through interconnections 19 to corresponding coupling electrodes 51a on the first peripheral portion 21a'' of the substrate 21''. Similarly, extensions thereof beyond the other, opposite edge of the display area 20'' provide connections to the respective ones of the second plurality of coupling electrodes 21b'' disposed on the second peripheral portion 21b'' of the substrate 21''. As is readily apparent from FIG. 9, the electrodes 51, 51a and 51b as well the interconnections 19, are formed directly on the surface of the substrate 21''. An insulating layer 52 is formed over the electrode pattern just described, and a protection layer 53 is formed on the insulating layer 52, at least in the display area 20''. Further, the first plurality of driving electrodes 54 is formed, as before described, on the surface of the insulating layer 52 so as to overlie and be capacitively coupled to the respectively corresponding first coupling electrodes 51a; in like manner, the second plurality of driving electrodes 56 is formed on the surface of the insulating layer 52 so as to overlie and be capacitively coupled to the respectively associated, second coupling electrodes 51b. Finally, an upper substrate 22 having Y-direction display electrodes 30, an insulating layer 31, and a protection layer 32 is positioned in spaced, parallel relationship to the lower substrate 21' and sealed thereto by sealing layers 34 so as define a sealed gas gap 33 therebetween which is filled with a discharge gas.

Based on experimental results in the operation of a gas discharge display in accordance with the invention, the inventors have determined that to achieve a maximum, utilizable sustain voltage margin, with display electrodes 51 of a width of 0.07 mm, the required coupling capacitance for each discharge cell, and thus for each display dot of the display matrix, must be greater than approximately 0.1 pF. In a 512×512 dot-matrix gas discharge display panel, this corresponds to a value of about 50 pF for each of the coupling electrodes 51a and 51b. The 50 pF capacitance requirement imposes severe conditions on the design of the coupling capacitors, as compared with the requirement established by equation (4) hereinabove. Specifically for a 512×512 dot-matrix gas discharge display panel, equation (4) must be modified in accordance with the following:

$$C_{11}=C_{12}\geqq 5C_0\approx 2{,}500C_{21}\approx 1{,}250C_{30x} \quad (5)$$

Based on equation (5), therefore, for display electrodes 51 having a width of approximately 0.07 mm, the area of each coupling electrode 51a and 51b must be about 6.25 $mm^2$.

On the other hand, to achieve a capacitance value of 50 pF for each of the coupling electrodes 51a and 51b of a 512×512 dot-matrix gas discharge display panel, taking into consideration the sustain voltage margin, the area S of each coupling electrode 51a and 51b must be approximately 23 $mm^2$, as determined in accordance with the following equation:

$$S=C\times t/(8.86\times 10^{-12}\times k)\ (m^2) \quad (6)$$

where C is capacitance in farads, t is the thickness of the dielectric layer in meters, and k is the specific dielectric constant of the dielectric layer material. In deriving the approximate value of $S=23\ mm^2$ from equation (6), the values of $t=2\times 10^{-5}$ (m) and $k=5$ have been assumed.

As is apparent from equation (6), however, the area, S, of each coupling electrode 51a and 51b may be decreased by reducing the thickness, t, of the insulating layer 52. In fact, successful operation employing a reduced thickness, insulating layer 52 of about 5 microns ($5\times 10^{-6}$ m) has been achieved. The use of a 5 micron thick insulating layer permits decreasing the area, S, of each coupling electrode 51a and 51b to about 5.5 $mm^2$, or less. Thus, the area S may be reduced, consistent with improvements in the design and fabricating processes in forming the electrodes, the insulating layers, and the like.

A plasma display panel in accordance with the third embodiment of the invention thus affords a multiplex wiring electrode pattern configuration which permits use of a larger area for each of the coupling electrodes 51a and 51b, through the provision of the interconnections 19 which are spaced at a smaller pitch than that of the display electrodes 51. The multiplex wiring circuit for the display electrodes 51 in the embodiment of FIGS. 7, 8 and 9 may accomodate a display matrix of 512×512 discharge cells, and thus corresponding display dots, in a practical manner, through the use of a reduced thickness of the dielectric, or insulating layer 52.

In accordance with the foregoing, the present invention affords a significant improvement in the multiplex wiring of the display electrodes of a plasma display panel, permitting a significant reduction in the number of driving circuits required therefor. Numerous modifications and adaptations of the embodiments of the invention as herein set forth will be apparent to those of skill in the art, and thus it is intended by the appended claims to cover all such modifications and adaptations which fall within the true spirit and scope of the invention.

What is claimed is:

1. A multiplex wiring circuit for the display electrodes of a gas discharge display panel, comprising:

a substrate having a display area in a central portion thereof and first and second peripheral portions extending beyond first and second, opposite edges of said display area;

a plurality of display electrodes formed on said substrate and extending across said display area portion thereof in generally parallel relationship, and in a predetermined direction generally traversing said first and second opposite edges of said display area, said plurality of display electrodes being arranged in a plurality of successive groups of a first predetermined number, and each said group comprising a plurality of successive display electrodes of a second predetermined number;

a first plurality of coupling electrodes respectively corresponding to said display electrodes, a first plurality of driving electrodes of said second predetermined number and respectively corresponding to said plurality of successive display electrodes of each of said successive groups thereof, and an insulating layer intervening between said first pluralities of coupling and driving electrodes, said first pluralities of coupling and driving electrodes and said intervening insulating layer being formed on said first peripheral portion of said substrate;

said first plurality of driving electrode being arranged in generally parallel relationship, and extending transversely of said predetermined direction;

said first plurality of coupling electrodes being arranged in a plurality of successive groups of said first predetermined number, corresponding to said successive groups of successive display electrodes, with each said group comprising a plurality of successive coupling electrodes of said second predetermined number, the corresponding said successive coupling electrodes of said successive groups being positioned in alignment with and capacitively coupled through said intervening insulating layer to said respectively corresponding driving electrodes of said first plurality thereof;

a second plurality of coupling electrodes respectively corresponding to said plurality of display electrodes, a second plurality of driving electrodes of said first predetermined number and respectively corresponding to said successive groups of said display electrodes, and an insulating layer intervening between said second pluralities of coupling and driving electrodes, said second pluralities of coupling and driving electrodes and said insulating layer being formed on said second peripheral portion of said substrate;

said second plurality of driving electrodes being disposed in generally aligned relationship in a direction traversing said predetermined direction and in positions corresponding to the respective said plurality of successive groups of said display electrodes;

said second plurality of coupling electrodes being disposed in generally aligned relationship in a direction traversing said predetermined direction with the coupling electrodes respectively associated with said successive display electrodes of each successive group thereof disposed in alignment with and capacitively coupled through said intervening insulating layer to the respectively corresponding driving electrode of said second plurality thereof;

first means individually connecting said display electrodes from said first edge of said display area to said respectively corresponding first coupling electrodes; and second means individually connecting said display electrodes from said second edge of said display area to said respectively corresponding second coupling electrodes.

2. A multiplex wiring circuit as recited in claim 1, wherein:

said predetermined direction of said plurality of display electrodes is generally perpendicular to said first and second, opposite edges of said display area; and said first plurality of driving electrodes extends substantially perpendicularly to said predetermined direction of said display electrodes.

3. A multiplex wiring circuit as recited in claim 2, wherein said second plurality of driving electrodes is disposed in a direction substantially perpendicular to said predetermined direction of said display electrodes.

4. A multiplex wiring circuit as recited in claim 1, wherein said first and second means for connecting said display electrodes to said respectively corresponding first and second coupling electrodes comprise corresponding first and second extensions of said display electrodes.

5. A multiplex wiring circuit as recited in claim 4, wherein:

said display electrodes are formed on the surface of said substrate in said display area thereof;

said first and second pluralities of driving electrodes are formed on the surface of said first and second peripheral portions of said substrate;

said insulating layers intervening between said first pluralities and said second pluralities of coupling and driving electrodes are formed respectively on said first and second pluralities of driving electrodes;

said first and second pluralities of coupling electrodes are formed on said respective insulating layers intervening between said first and second pluralities of coupling electrodes and the respective first and second pluralities of driving electrodes; and said first and second extensions of said display electrodes extend from said display area of said substrate at the respective first and second edges thereof and on said respective, intervening insulating layers to the respective said first and second pluralities of coupling electrodes.

6. A multiplex wiring circuit as recited in claim 5, wherein there is further provided an insulating layer formed on said display electrodes in said display area of said substrate.

7. A multiplex wiring circuit as recited in claim 6, wherein there is further provided a protection layer formed on said insulating layer in said display area.

8. A multiplex wiring circuit as recited in claim 4, wherein:

said display electrodes, the respective said first and second extensions of said display electrodes and the respective said first and second pluralities of coupling electrodes are formed on the surface of said substrate respectively in said display area and said first and second peripheral portions thereof, and there is further provided:

an insulating layer extending over said display electrodes, said first and second extensions thereof, and said coupling electrodes and providing thereby said intervening insulating layers between the respective said first and second pluralities of coupling and driving electrodes; and said first and second pluralities of driving electrodes are formed on said insulating layer.

9. A multiplex wiring circuit as recited in claim 8, wherein there is further provided a protection layer formed on said insulating layer in the display area portion of said substrate.

10. A multiplex wiring circuit as recited in claim 1, wherein:

each of said first plurality of coupling electrodes is of elongated configuration, corresponding ones of said successive coupling electrodes of said plurality of successive groups thereof being disposed in spaced, aligned relationship with respect to the elongated configurations thereof and extending transversely to said predetermined direction, thereby defining spacings between adjacent ends of the aligned said second coupling electrodes; and said first connecting means comprises wiring interconnections including first portions extending from and in alignment with the respective said coupling electrodes of said first plurality and respective, second portions extending in generally parallel relationship, transversely to said first portions thereof and thus in said predetermined direction, but with a reduced pitch relatively to the pitch of said display electrodes.

11. A multiplex wiring circuit as recited in claim 10, wherein:

each of said first plurality of driving electrodes is disposed in alignment with the respectively corresponding ones of said plurality of successive coupling electrodes of said plurality of groups thereof and furthermore is of a segmented configuration having first portions of a width and length substantially corresponding to the width and length of the respective, first coupling electrodes capacitively coupled thereto and second portions of reduced width interconnecting said first portions in said spacings between said adjacent ends of the corresponding said coupling electrodes.

12. A multiplex wiring circuit as recited in claim 11, wherein there are further provided:

a first plurality of driving terminals disposed on a selected one of said first and second peripheral portions of said substrate and electrically connected to respective ones of said first plurality of driving electrodes; and a second plurality of driving terminals disposed on the common, selected peripheral portion of said substrate and electrically connected to respective ones of said second plurality of driving electrodes.

13. A gas discharge display panel, comprising:

first and second substrates, each thereof defining a display area;

first and second pluralities of display electrodes respectively formed on said first and second substrates, each said plurality of display electrodes extending in generally parallel relationship across, and in a predetermined direction relative to, said display area portion of the respective said substrate;

first and second insulating layers disposed on said first and second pluralities of display electrodes;

said first and second substrates being assembled in generally parallel, spaced relationship to define a discharge gas gap therebetween and with said respective display areas thereof in alignment and said first and second pluralities of display electrodes spatially intersecting in said aligned display areas, said spatial intersections defining discharge cells corresponding to individual display dots of a matrix thereof in said display area;

a discharge gas received within said discharge gas gap;

at least one multiplex wiring circuit formed on and associated with a corresponding one of said first and second substrates, each said associated substrate having first and second peripheral portions extending beyond corresponding first and second opposite edges of said display area thereof, in said predetermined direction, and each said multiplex wiring circuit comprising:

a first plurality of coupling electrodes respectively corresponding to said display electrodes of the associated substrate, a first plurality of driving electrodes of said second predetermined number and respectively corresponding to said plurality of successive display electrodes of each of said successive groups thereof, and an insulating layer intervening between said first pluralities of coupling and driving electrodes, said first pluralities of coupling and driving electrodes and said intervening insulating layer being formed on said first peripheral portion of said associated substrate;

said first plurality of driving electrodes being arranged in generally parallel relationship, and extending transversely of said predetermined direction;

said first plurality of coupling electrodes being arranged in a plurality of successive groups of said first predetermined number, corresponding to said successive groups of successive display electrodes, with each said group comprising a plurality of successive coupling electrodes of said second predetermined number, the corresponding said successive coupling electrodes of said successive groups being positioned in alignment with and capacitively coupled through said intervening insulating layer to said respectively corresponding driving electrodes of said first plurality thereof;

a second plurality of coupling electrodes respectively corresponding to said plurality of display electrodes, a second plurality of driving electrodes of said first predetermined number and respectively corresponding to said successive groups of said display electrodes, and an insulating layer intervening between said second pluralities of coupling and driving electrodes, said second pluralities of coupling and driving electrodes and said insulating layer being formed on said second peripheral portion of said associated substrate;

said second plurality of driving electrodes being disposed in generally aligned relationship in a direction traversing said predetermined direction and in positions corresponding to the respective said plurality of successive groups of said display electrodes;

said second plurality of coupling electrodes being disposed in generally aligned relationship in a direction traversing said predetermined direction with the coupling electrodes respectively associated with said successive display electrodes of each successive group thereof disposed in alignment with and capacitively coupled through said intervening insulating layer to the respectively corresponding driving electrode of said second plurality thereof;

first means individually connecting said display electrodes from said first edge of said display area of said associated substrate to said respectively corresponding first coupling electrodes; and second means individually connecting said display electrodes from said second edge of said display area of said associated substrate to said respectively corresponding second coupling electrodes.

14. A gas discharge display panel as recited in claim 13, wherein:

only said first substrate has said first and second peripheral portions; and said multiplex wiring circuit is formed on and associated with only said first substrate.

15. A gas discharge display panel as recited in claim 13, wherein:

each of said first and second substrates has respective, said first and second peripheral portions; and first and second multiplex wiring circuits are respectively formed on and associated with said first and second substrates.

* * * * *

UNITED STATES PATENT AND TRADEMARK OFFICE

CERTIFICATE OF CORRECTION

PATENT NO. : 4,629,942

DATED : December 16, 1986

INVENTOR(S) : Kenji HORIO et al.

It is certified that error appears in the above-identified patent and that said Letters Patent is hereby corrected as shown below:

Cover page, item [30], after "59-182078" insert --as to patent claims 10, 11 and 12 only--;

item [73], "Kanagawa" should be --Kawasaki-Shi--

Col. 5, line 48, "Appication" should be --Application--.

Col. 8, line 15, "$V_2$" should be --V/2--.

Signed and Sealed this

Thirty-first Day of May, 1988

*Attest:*

*Attesting Officer*

DONALD J. QUIGG

*Commissioner of Patents and Trademarks*